US011591679B2

(12) United States Patent
Lee

(10) Patent No.: US 11,591,679 B2
(45) Date of Patent: Feb. 28, 2023

(54) LOW-TEMPERATURE STEEL MATERIAL HAVING EXCELLENT TOUGHNESS IN WELDING PORTION THEREOF AND MANUFACTURING METHOD THEREFOR

(71) Applicant: POSCO, Pohang-si (KR)

(72) Inventor: Hak-Cheol Lee, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 167 days.

(21) Appl. No.: 16/955,432

(22) PCT Filed: Aug. 21, 2018

(86) PCT No.: PCT/KR2018/009605
§ 371 (c)(1),
(2) Date: Jun. 18, 2020

(87) PCT Pub. No.: WO2019/124671
PCT Pub. Date: Jun. 27, 2019

(65) Prior Publication Data

US 2021/0010114 A1 Jan. 14, 2021

(30) Foreign Application Priority Data

Dec. 24, 2017 (KR) ..... 10-2017-0178946

(51) Int. Cl.

| | |
|---|---|
| ***C22C 38/50*** | (2006.01) |
| ***C21D 1/18*** | (2006.01) |
| ***C21D 6/00*** | (2006.01) |
| ***C21D 8/02*** | (2006.01) |
| ***C21D 9/46*** | (2006.01) |

(52) U.S. Cl.
CPC ..... *C22C 38/50* (2013.01); *C21D 1/18* (2013.01); *C21D 6/004* (2013.01); *C21D 8/0205* (2013.01); *C21D 8/0226* (2013.01); *C21D 9/46* (2013.01)

(58) Field of Classification Search
CPC ..... C21D 1/18; C21D 6/004; C21D 8/0205; C21D 8/0226; C21D 9/46; C22C 38/00; C22C 38/02; C22C 38/04; C22C 38/44; C22C 38/50
USPC ..... 420/112
See application file for complete search history.

(56) References Cited

U.S. PATENT DOCUMENTS

| | | | |
|---|---|---|---|
| 2018/0073116 | A1 | 3/2018 | Zhao et al. |
| 2021/0108298 | A1 | 4/2021 | Kagaya et al. |

FOREIGN PATENT DOCUMENTS

| | | | | |
|---|---|---|---|---|
| CN | 103498100 | A | 1/2014 | |
| CN | 104131225 | A | 11/2014 | |
| CN | 104278210 | A | 1/2015 | |
| CN | 104789892 | A | 7/2015 | |
| CN | 104928592 | A | 9/2015 | |
| EP | 1942203 | A1 | 7/2008 | |
| EP | 2871255 | A1 | 5/2015 | |
| EP | 3130687 | A1 | 2/2017 | |
| EP | 3130687 | A1 * | 2/2017 | ..... C21D 6/001 |
| EP | 3392361 | A1 | 10/2018 | |
| JP | H06-192729 | A | 7/1994 | |
| JP | H09-302445 | A | 11/1997 | |
| JP | 2001-240942 | A | 9/2001 | |
| JP | 2001-295083 | A | 10/2001 | |
| JP | 2002-129280 | A | 5/2002 | |
| JP | 2008-081776 | A | 4/2008 | |
| JP | 2011-219848 | A | 11/2011 | |
| JP | 2013-014811 | A | 1/2013 | |
| JP | 2014-034708 | A | 2/2014 | |
| JP | 2015-074808 | A | 4/2015 | |
| JP | 2015-086403 | A | 5/2015 | |
| JP | 2015-199983 | A | 11/2015 | |
| JP | 2016-183387 | A | 10/2016 | |
| JP | 6394835 | B1 | 9/2018 | |
| KR | 10-2004-0054198 | A | 6/2004 | |
| KR | 10-2008-0038226 | A | 5/2008 | |
| KR | 10-0957929 | B1 | 5/2010 | |
| KR | 10-2013-0103422 | A | 9/2013 | |
| WO | 2007/080645 | A1 | 7/2007 | |
| WO | WO-2015156179 | A1 * | 10/2015 | ..... C21D 6/001 |
| WO | 2017/104599 | A1 | 6/2017 | |

OTHER PUBLICATIONS

NPL: on-line translation for JP 2015086403 2015 (Year: 2015).*
Chinese Office Action dated Mar. 26, 2021 issued in Chinese Patent Application No. 201880081865.1 (with English translation).
Japanese Office Action dated Sep. 7, 2021 issued in Japanese Patent Application No. 2020-534170.
Chinese Office Action dated Nov. 22, 2021 issued in Chinese Patent Application No. 201880081865.1 (with English translation).
International Search Report dated Nov. 26, 2018 issued in International Patent Application No. PCT/KR2018/009605 (along with English translation).

(Continued)

*Primary Examiner* — Jie Yang
(74) *Attorney, Agent, or Firm* — Morgan, Lewis & Bockius LLP

(57) ABSTRACT

Provided according to a preferable aspect of the present invention are a low-temperature steel material having excellent toughness in a welding portion thereof and a manufacturing method therefor, the low-temperature steel material comprising, by weight %, 0.02-0.06% of C, 6.0-7.5% of Ni, 0.4-1.0% of Mn, 0.02-0.15% of Si, 0.02-0.3% of Mo, 0.02-0.3% of Cr, 50 ppm or less of P, 10 ppm or less of S, 0.005-0.015% of Ti, 60 ppm or less of N, with a Ti/N weight % ratio of 2.5 of 4, and the balance of iron (Fe) and other inevitable impurities; and having: an effective grain size of 50 micrometers or less, with a boundary angle found to be 15 degrees or greater as measured by EBSD in an area of a fusion line (FL)-FL+1 mm in a weld heat-affected zone of a weld portion welded at a heat input of 5-50 kJ/cm; and an impact toughness of 70 J or higher at −196° C. as measured in an area of fusion line (FL)-FL+1 mm.

9 Claims, No Drawings

(56) References Cited

OTHER PUBLICATIONS
Extended European Search Report dated Aug. 6, 2020 issued in European Patent Application No. 18890244.9.

* cited by examiner

LOW-TEMPERATURE STEEL MATERIAL HAVING EXCELLENT TOUGHNESS IN WELDING PORTION THEREOF AND MANUFACTURING METHOD THEREFOR

CROSS-REFERENCE OF RELATED APPLICATIONS

This application is the U.S. National Phase under 35 U.S.C. § 371 of International Patent Application No. PCT/KR2018/009605, filed on Aug. 21, 2018, which in turn claims the benefit of Korean Application No. 10-2017-0178946, filed on Dec. 24, 2017, the entire disclosures of which applications are incorporated by reference herein.

TECHNICAL FIELD

The present disclosure relates to a low-temperature steel material having excellent toughness in a welding portion and a method of manufacturing the same, and more particularly, to a low-temperature steel material having excellent toughness in a welding portion containing nickel and a method of manufacturing the same.

BACKGROUND ART

Recently, interest in eco-friendly fuels has been amplified as global environmental regulations have been strengthened due to global warming. Liquefied Natural Gas (LNG), a representative eco-friendly fuel, is steadily increasing in global LNG consumption due to cost reductions and increased efficiency through the development of related technologies. In 1980, the consumption of LNG, which was only 23 million tons in six countries, has been doubling about every 10 years. According to the expansion and growth of the LNG market, existing operating facilities are being remodeled or expanded between LNG producing countries, and countries where natural gas is being produced are also trying to construct production facilities to enter the LNG market.

LNG storage containers are classified according to various criteria such as the purpose of the equipment (storage tanks, transport tanks), installation location, and internal and external tank types, etc. Thereamong, the internal tank is divided into a 9% Ni steel internal tank, a membrane internal tank, and a concrete internal tank according to the type thereof, that is, material and shape. Recently, an LNG storage container in the form of 9% Ni steel has been used to improve the stability of the LNG carrier. Global demand for 9% Ni steel is on the rise as the use of the LNG storage containers expands from lnand storage tanks to transport tanks.

In general, to be used as a material for an LNG storage container, it must have excellent impact toughness at cryogenic temperatures, and a high strength level and ductility are required for stability of the structure. 9% Ni steel is usually produced through the process of QT (Quenching-Tempering) or QLT (Quenching-Lamellarizing-Tempering) after rolling, and through this process, soft residual austenite is provided as a secondary phase on the martensite matrix having fine grains, thereby exhibiting good impact toughness at cryogenic temperature. However, in the case of 9% Ni steel, as it has to have a high Ni content to secure toughness, the steel price rises according to price fluctuations of the high cost element Ni, which acts as a burden to the steel user.

To alleviate the price problem of 9% Ni steel, the development and specification of low Ni-type steel with a lower Ni content than that of existing 9% Ni steel was led by some steel companies, and to resolve the problem of deteriorations in toughness due to Ni reduction, by using the QLT or DQLT (Direct Quenching-Lamellarizing-Tempering) process, to include the L process that has a great effect on toughness improvement, it was possible to reduce the amount of Ni added by about 20%, as compared to the existing 9% Ni steel.

However, instead of reducing the Ni addition amount of 20%, other alloy elements should be added to secure hardenability, and thus, the alloy cost reduction amount is not high, and in some steel companies, the DQLT process is introduced instead of the QLT process, to apply cryogenic rolling during rolling before heat treatment to refine the grain size. Therefore, it still has a problem in that the rolling productivity is significantly lowered.

In addition, in the Ni steel for low temperature, the most essential part to secure toughness is the welding part, and the welding part receives high heat such that the microstructure of the existing base material is changed. Therefore, it may be difficult to guarantee impact toughness.

In the weld heat-affected zone, in the case of a sub-critical heat-affected zone (SCHAZ), which is heated to an $Ac_3$ or lower temperature, only some structures are reverse-transformed, and thus, it is easy to secure toughness with additional structure refinement and tempering effects, but the Coarse Grain Heat Affected Zone (CGHAZ) is heated to a high temperature, and thus, it may be difficult to secure impact toughness because all the microstructures of the refined base material is coarsened due to the existing low-temperature rolling and heat treatment. In the case of the low Ni-type steel material in which 20% Ni is reduced compared to the existing 9% Ni steel, there is a problem in which the impact toughness of a weld heat-affected zone is greatly reduced by Ni reduction.

DISCLOSURE

Technical Problem

An aspect of the present disclosure is to provide a low-temperature steel material having excellent toughness in a welding portion thereof.

Another aspect of the present disclosure is to provide a method of manufacturing a low-temperature steel material having excellent toughness in a welding portion thereof.

Technical Solution

According to an aspect of the present disclosure, a low-temperature steel material having excellent welding-portion toughness, includes, in weight %, 0.02 to 0.06% of C, 6.0 to 7.5% of Ni, 0.4 to 1.0% of Mn, 0.02 to 0.15% of Si, 0.02 to 0.3% of Mo, 0.02 to 0.3% of Cr, 50 ppm or less of P, 10 ppm or less of S, 0.005 to 0.015% of Ti, 60 ppm or less of N, a Ti/N weight % ratio of 2.5 of 4, and a balance of iron (Fe) and other unavoidable impurities, wherein in a weld heat-affected zone of a welding portion welded with a heat input of 5 to 50 kJ/cm, an effective grain size having a boundary angle of 15 degrees or greater in an area of a fusion line (FL) to FL+1 mm, measured by EBSD, is 50 micrometers or less, and an impact toughness measured in the area of the fusion line (FL) to FL+1 mm is 70 J or higher at −196° C.

A yield strength of the low-temperature steel material may be 585 MPa or higher.

An impact transition temperature of the low-temperature steel material may be −196° C. or lower.

A thickness of the low-temperature steel material may be 5 to 50 mm.

According to another aspect of the present disclosure, a method of manufacturing a low-temperature steel material having excellent welding-portion toughness, includes:

a slab heating operation of heating a slab to a temperature of 1100 to 1200° C., the slab including, in weight %, 0.02 to 0.06% of C, 6.0 to 7.5% of Ni, 0.4 to 1.0% of Mn, 0.02 to 0.15% of Si, 0.02 to 0.3% of Mo, 0.02 to 0.3% of Cr, 50 ppm or less of P, 10 ppm or less of S, 60 ppm or less of N, 0.005 to 0.015% of Ti, a Ti/N weight % ratio of 2.5 to 4, and a balance of iron (Fe) and other unavoidable impurities;

a hot rolling operation of obtaining a hot-rolled steel sheet by hot rolling the slab heated in the slab heating operation;

air-cooling the hot rolled steel sheet;

a single-phase region heat treatment quenching operation of reheating the air-cooled steel sheet to 800 to 950° C. and then performing quenching through water cooling;

after the single-phase region heat treatment quenching operation, a two-phase region heat treatment quenching operation of reheating the steel sheet to a two-phase region temperature of 680 to 750° C., and then, performing quenching through water cooling; and reheating the steel sheet to 570 to 620° C., followed by tempering, and then, performing air cooling, after the two-phase region heat treatment quenching operation.

In the method of manufacturing a low-temperature steel material, a hot finish rolling temperature during the hot rolling may be 700 to 1000° C.

In the method of manufacturing a low-temperature steel material, the tempering may be performed for 1.9t+40 to 80 minutes, where t is a thickness of a steel sheet (mm).

In the method of manufacturing a low-temperature steel material, a thickness of the hot-rolled steel sheet may be 5 to 50 mm.

Advantageous Effects

According to an exemplary embodiment of the present disclosure, a Ni steel material for a low-temperature tank having excellent toughness in a welding portion may be obtained.

BEST MODE FOR INVENTION

In an exemplary embodiment of the present disclosure, to solve the problem in which the toughness of the welding portion of the existing low-Ni type steel deteriorates, by adding Ti and controlling the Ti/N ratio to be in the range of 2.5 to 4; in a weld heat-affected zone of a welding portion welded within a heat input range of 5 to 50 kJ/cm, an effective grain size having a boundary angle of 15 degrees or greater in an area of a fusion line (FL) to FL+1 mm, measured by EBSD, is controlled to be 50 micrometers or less, and thus, an impact toughness measured in the area of the fusion line (FL) to FL+1 mm is 70 J or higher at −196° C., thereby improving toughness of the weld heat-affected zone.

Hereinafter, a steel material for low temperature having excellent toughness in a welding portion according to an exemplary embodiment of the present disclosure will be described.

According to an exemplary embodiment of the present disclosure, a low-temperature steel material having excellent welding-portion toughness, includes, in weight %, 0.02 to 0.06% of C, 6.0 to 7.5% of Ni, 0.4 to 1.0% of Mn, 0.02 to 0.15% of Si, 0.02 to 0.3% of Mo, 0.02 to 0.3% of Cr, 50 ppm or less of P, 10 ppm or less of S, 0.005 to 0.015% of Ti, 60 ppm or less of N, a Ti/N weight % ratio of 2.5 of 4, and a balance of iron (Fe) and other unavoidable impurities.

C: 0.02 to 0.06% by Weight (hereinafter also referred to as "%")

C promotes martensitic transformation and lowers the Ms temperature (martensitic transformation temperature) to refine the grain size, and is an important element in stabilizing residual austenite by diffusing to grain boundaries and phase boundaries when tempered. It may be preferable to add 0.02% or more to secure the strength and toughness of the base material. However, as the C content increases, the problem of deteriorating toughness may occur by increasing the strength of the fusion line (FL) to FL+1 mm, and thus, it may be preferable to limit the upper limit of the content to 0.06%.

Ni: 6.0 to 7.5%

Ni is the most important element that promotes the martensite/bainite transformation to improve the strength of the base material and to improve the toughness of the martensite structure formed in the weld heat-affected zone, and thus, to satisfy the impact toughness of the weld heat-affected zone proposed in the present disclosure, it may be preferable to add Ni in an amount of 6.0% or more. However, if Ni is added in an amount in excess of 7.5%, there is a possibility that the toughness will be deteriorated due to the increase in martensitic strength due to high hardenability, and thus, it may be preferable to limit the Ni content to 6.0 to 7.5%.

Mn: 0.4 to 1.0%

Mn is an element that promotes C/Ni and martensite/bainite transformation to improve the strength of the base material, and it may be preferable to add Mn in an amount of 0.4% or more. However, if the Mn content exceeds 1.0%, the toughness may decrease as the strength of the weld heat-affected zone increases, and thus, it may be preferable to limit the content of manganese to 0.4 to 1.0%. The preferred Mn content may be 0.5 to 0.9%.

Si: 0.02 to 0.15%

Si acts as a deoxidizer and also suppresses the formation of carbides during tempering, thereby improving the stability of the retained austenite, and thus, it is preferred to contain 0.02% or more. However, if the Si content is relatively too high, the strength of the weld heat-affected zone increases and impact toughness decreases, and thus, it may be preferable to limit the Si content to 0.02 to 0.15%.

Mo: 0.02 to 0.3%

Mo is an element that promotes the formation of martensite/bainite upon cooling as an element for improving hardenability, and may actually serve to improve the hardenability when 0.02% or more is added. However, if it is added in an amount in excess of 0.3%, the hardenability may increase excessively, resulting in a decrease in toughness due to an increase in the strength of a welding portion, and thus, it may be preferable to limit the Mo content to 0.02 to 0.3%.

Cr: 0.02 to 0.3%

Cr is an element that improves hardenability and promotes the formation of martensite/bainite upon cooling, and it needs to be added in an amount of 0.02% or more because it helps secure strength through solid solution strengthening. However, if added in an amount in excess of 0.3%, the hardenability may increase excessively, resulting in a decrease in toughness due to an increase in the strength of the welding portion, and thus, it may be preferable to limit the Cr content to 0.02 to 0.3% according to an exemplary embodiment of the present disclosure.

P: 50 ppm or Less, S: 10 ppm or Less

P and S are elements that cause brittleness at the grain boundaries or forms coarse inclusions, which may deteriorate the impact toughness of the welding portion and generate high temperature cracks, and thus, the P content may be limited to 50 ppm or less, and the S content may be limited to 10 ppm or less.

Ti: 0.005 to 0.015%, and Ti/N Weight % Ratio: 2.5 to 4

Ti reacts with N to generate TiN at high temperature, and the formed TiN may hinder the growth of austenite grains when the vicinity of the fusion line (FL) is heated to a high temperature at the time of rolling or welding the recrystallization region, thereby refining the final grain size. In order for TiN to be formed and prevent the grain growth, Ti should be added in an amount of 0.005% or more, but if it is added in an amount in excess of 0.015%, it may be coarse in the form of a complex carbide of Ti(C,N) to degrade toughness. Therefore, it may be preferable to limit the Ti content to 0.005 to 0.015%.

In addition, since Ti and N are combined in 3.4 to 1 a weight %, if the ratio of Ti/N is significantly low, such as 2.5 or less, the problem of deteriorating the toughness by the remaining N may occur. If Ti/N is 4 or more, coarse TiN crystals are formed at a relatively high temperature, which may degrade impact toughness. Therefore, it may be preferable to limit the weight % ratio of Ti/N to 2.5 to 4.

N: 60 ppm or Less

N (nitrogen) is combined with Ti to form TiN, which serves to prevent austenite grain growth at a high temperature. However, if free N, which is not combined with Ti, is contained in steel, impact toughness may be reduced, and thus, it may be desirable to limit the content to 60 ppm or less.

The remaining component according to the exemplary embodiment of the present disclosure is iron (Fe). However, in the normal steel manufacturing process, unintended impurities from raw materials or the surrounding environment may be inevitably mixed, and therefore, cannot be excluded. These impurities are known to anyone skilled in the ordinary steel manufacturing process, and thus, are not specifically mentioned in this specification.

In the case of a low-temperature steel material having excellent welding-portion toughness according to an exemplary embodiment of the present disclosure, in a weld heat-affected zone of a welding portion welded with a heat input of 5 to 50 kJ/cm, an effective grain size having a boundary angle of 15 degrees or greater in an area of a fusion Line (FL) to FL+1 mm, measured by EBSD, is 50 micrometers or less, and thus, an impact toughness measured in the area of the fusion line (FL) to FL+1 mm is 70 J or higher at −196° C.

A microstructure of the steel material may include tempered martensite, tempered bainite and residual austenite.

A microstructure of the welding portion may include martensite and tempered martensite.

TiN precipitates or Ti(C,N) precipitates may be formed in the steel material.

A yield strength of the steel material may be 585 MPa or more.

An impact transition temperature of the steel material may be −196° C. or less.

A thickness of the steel material may be 5 to 50 mm.

Hereinafter, a method of manufacturing a low-temperature steel material having excellent welding-portion toughness according to another exemplary embodiment of the present disclosure will be described.

According to another exemplary embodiment of the present disclosure, a method of manufacturing a low-temperature steel material having excellent welding-portion toughness includes:

a slab heating operation of heating a slab to a temperature of 1100 to 1200° C., the slab including, in weight %, 0.02 to 0.06% of C, 6.0 to 7.5% of Ni, 0.4 to 1.0% of Mn, 0.02 to 0.15% of Si, 0.02 to 0.3% of Mo, 0.02 to 0.3% of Cr, 50 ppm or less of P, 10 ppm or less of S, 0.005 to 0.015% of Ti, 60 ppm or less of N, a Ti/N weight % ratio of 2.5 to 4, and a balance of iron (Fe) and other unavoidable impurities;

a hot rolling operation of obtaining a hot-rolled steel sheet by hot rolling the slab heated as described above;

air-cooling the hot rolled steel sheet;

a single-phase region heat treatment quenching operation of reheating the air-cooled steel sheet to 800 to 950° C. and then performing quenching through water cooling;

after the single-phase region heat treatment quenching operation, a two-phase region heat treatment quenching operation of reheating the steel sheet to a two-phase region temperature of 680 to 750° C., and then, performing quenching through water cooling; and reheating the steel sheet to 570 to 620° C., followed by tempering, and then, performing air cooling, after the two-phase region heat treatment quenching operation.

The steel material manufacturing process according to an exemplary embodiment of the present disclosure includes slab heating-hot rolling-air cooling after hot rolling-austenitic single phase-heat region heat treatment quenching-two-phase region heat treatment quenching-tempering and air cooling after tempering.

Slab Heating, Hot Rolling and Air-Cooling after Hot Rolling

The slab formed as described above is heated.

It may be preferable to perform the heating at 1100 to 1200° C., which is for removing the casting structure and homogenizing the components.

The slab heated as described above is hot rolled to obtain a hot rolled steel sheet. The heated slab is subjected to hot rolling (rough rolling and finishing rolling) after heating to adjust the shape thereof. The effect of reducing the grain size through the recrystallization of coarse austenite along with the destruction of the casting structure such as dendrite or the like formed during casting may be obtained by this hot rolling. After completion of hot rolling, cooling is performed to room temperature through air cooling.

At this time, the hot finish rolling temperature may be 700 to 1000° C.

The thickness of the hot-rolled steel sheet may be 5 to 50 mm.

Single-Phase Region Heat Treatment Quenching

After reheating the steel sheet air-cooled as described above to 800 to 950° C., a single-phase region heat treatment quenching is performed by quenching through water cooling.

After hot rolling, the air-cooled steel sheet is heated to an austenite single-phase region temperature, to perform quenching heat treatment. This single-phase region heat treatment quenching is performed to obtain austenite grain size refinement by heat treatment and a martensite/bainite structure having fine packets during cooling. To cause sufficient recrystallization in the austenite single-phase region and to maintain a fine grain size, the heat treatment temperature of the single-phase region quenching may preferably be 800 to 950° C.

Two-Phase Region Heat Treatment Quenching

After the single-phase region heat treatment quenching, the steel sheet is reheated to a two-phase region temperature of 680 to 750° C., and is then quenched through water cooling.

As described above, the single-phase region heat-treatment quenched steel sheet is reheated to an austenite and ferrite two-phase region temperature, and then quenched after the heat treatment. This two-phase region heat treatment quenching process is performed to further refine the structure refined during the existing two-phase region heat treatment. In the case of performing the two-phase region heat treatment, austenite is newly formed between the prior austenite grain boundaries and martensitic lath after quenching, and since it is a two-phase region, only a portion of the austenite other than the entirety is reverse transformed into austenite. Therefore, the reverse-transformed austenite during quenching is transformed into finer martensite again, thereby securing more fine structure. In addition, in the martensite which is not reverse-transformed into austenite during the two-phase region heat treatment, as the components move to the martensite lath boundary, a seed capable of easily forming residual austenite is formed upon subsequent tempering.

Tempering and Air Cooling after Tempering

Cryogenic steel sheet according to an exemplary embodiment of the present disclosure softens the matrix structure upon tempering to improve impact toughness, and also forms stable residual austenite even at −196° C. to improve impact toughness. If tempering to a temperature exceeding 620° C., the stability of austenite formed in the microstructure decreases, and as a result, the austenite may easily transform into martensite at cryogenic temperature, and impact toughness may deteriorate. Therefore, the tempering may preferably be performed in the tempering temperature range of 570 to 620° C.

In this case, the tempering may be performed for 1.9t+40 to 80 minutes [t is a steel thickness (mm)].

According to the method of manufacturing a low-temperature steel material having excellent welding-portion toughness, a low-temperature steel material having excellent welding-portion toughness, in which a yield strength is 585 MPa or more, an impact transition temperature is −196° C. or less, and in a weld heat-affected zone of a welding portion welded with a heat input of 5 to 50 kJ/cm, an effective grain size having a boundary angle of 15 degrees or greater in an area of a fusion line (FL) to FL+1 mm, measured by EBSD, is 50 micrometers or less, and an impact toughness measured in the area of the fusion line (FL) to FL+1 mm is 70 J or higher at −196° C., may be manufactured.

MODE FOR INVENTION

Hereinafter, the present disclosure will be described in more detail through examples. However, it is necessary to note that the following examples are only for explaining the present disclosure by way of example and not for limiting the scope of the present disclosure. This is because the scope of the present disclosure is determined by matters described in the claims and reasonably inferred therefrom.

The steel slab having a thickness of 250 mm, which was composed as illustrated in Table 1, was hot rolled under the conditions of Table 2, to obtain a steel sheet having the thickness of Table 2, and then quenched and tempered under the conditions of Table 2. At this time, the tempering time was 1.9 t+40 to 50 minutes [t is a steel thickness (mm)]. For the steel sheet manufactured as described above, the base material yield strength (MPa), the base material impact transition temperature (° C.), and the weld heat-affected zone characteristics were evaluated, and the results are illustrated in Table 3 below. For evaluation of the weld heat-affected zone, welding was performed with a heat input amount of 5 to 50 kJ/cm, and the impact toughness of an area of a fusion line (FL) to FL+1 mm, and the average grain size of the microstructure of the area of the fusion line (FL) to FL+1 mm, were observed, and the results are illustrated in Table 3 below.

The structure of the welding portion included both martensite and tempered martensite.

TABLE 1

| Classification | C | Ni | Mn | Si | P | S | Mo | Cr | Ti | N | Ti/N |
|---|---|---|---|---|---|---|---|---|---|---|---|
| Inventive Steel 1 | 0.042 | 6.82 | 0.53 | 0.04 | 0.0024 | 0.0006 | 0.23 | 0.21 | 0.012 | 0.0032 | 3.8 |
| Inventive Steel 2 | 0.035 | 7.23 | 0.64 | 0.06 | 0.0037 | 0.0005 | 0.07 | 0.11 | 0.009 | 0.0027 | 3.3 |
| Inventive Steel 3 | 0.051 | 7.02 | 0.73 | 0.1 | 0.0029 | 0.0004 | 0.15 | 0.19 | 0.011 | 0.0036 | 3.1 |
| Inventive Steel 4 | 0.043 | 6.29 | 0.89 | 0.08 | 0.0037 | 0.0006 | 0.28 | 0.23 | 0.013 | 0.0042 | 3.1 |
| Inventive Steel 5 | 0.056 | 7.12 | 0.49 | 0.07 | 0.0032 | 0.0008 | 0.19 | 0.07 | 0.01 | 0.0035 | 2.9 |
| Inventive Steel 6 | 0.043 | 6.41 | 0.55 | 0.09 | 0.0027 | 0.0006 | 0.29 | 0.15 | 0.011 | 0.0043 | 2.6 |
| Comparative Steel 1 | 0.051 | 7.02 | 0.65 | 0.09 | 0.0024 | 0.0007 | 0.19 | 0.23 | 0.028 | 0.0037 | 7.6 |
| Comparative Steel 2 | 0.043 | 6.54 | 0.54 | 0.06 | 0.0041 | 0.0005 | 0.18 | 0.21 | 0.001 | 0.0041 | 0.2 |
| Comparative Steel 3 | 0.052 | 7.09 | 0.54 | 0.05 | 0.0028 | 0.0005 | 0.22 | 0.16 | 0.014 | 0.0089 | 1.6 |
| Comparative Steel 4 | 0.094 | 6.71 | 0.62 | 0.09 | 0.0024 | 0.0007 | 0.21 | 0.14 | 0.013 | 0.0038 | 3.4 |
| Comparative Steel 5 | 0.036 | 5.54 | 0.76 | 0.09 | 0.0037 | 0.0005 | 0.16 | 0.23 | 0.008 | 0.0027 | 3.0 |

TABLE 1-continued

| Classification | C | Ni | Mn | Si | P | S | Mo | Cr | Ti | N | Ti/N |
|---|---|---|---|---|---|---|---|---|---|---|---|
| Comparative Steel 6 | 0.042 | 6.89 | 0.64 | 0.11 | 0.0024 | 0.0007 | 0.45 | 0.43 | 0.009 | 0.0023 | 3.9 |
| Comparative Steel 7 | 0.055 | 7.02 | 0.55 | 0.36 | 0.0062 | 0.0031 | 0.15 | 0.15 | 0.012 | 0.0035 | 3.4 |
| Comparative Steel 8 | 0.046 | 6.84 | 1.34 | 0.12 | 0.0041 | 0.0007 | 0.21 | 0.16 | 0.011 | 0.0034 | 3.2 |

TABLE 2

| Classification | Steel Grade | Slab Reheating Temperature (° C) | Hot Finish Rolling Temperature (° C) | Steel Thickness (mm) | Single-phase Region Quenching Temperature (° C) | Two-phase Region Quenching Temperature (° C) | Tempering Temperature (° C) |
|---|---|---|---|---|---|---|---|
| Inventive Example 1 | Inventive Steel 1 | 1130 | 952 | 25 | 815 | 721 | 589 |
| Inventive Example 2 | Inventive Steel 2 | 1126 | 981 | 30 | 864 | 716 | 576 |
| Inventive Example 3 | Inventive Steel 3 | 1126 | 854 | 20 | 832 | 733 | 592 |
| Inventive Example 4 | Inventive Steel 4 | 1158 | 956 | 25 | 877 | 694 | 603 |
| Inventive Example 5 | Inventive Steel 5 | 1108 | 850 | 40 | 834 | 703 | 611 |
| Inventive Example 6 | Inventive Steel 6 | 1166 | 824 | 15 | 901 | 715 | 594 |
| Comparative Example 1 | Comparative Steel 1 | 1148 | 902 | 35 | 815 | 722 | 603 |
| Comparative Example 2 | Comparative Steel 2 | 1165 | 864 | 15 | 864 | 716 | 584 |
| Comparative Example 3 | Comparative Steel 3 | 1137 | 903 | 25 | 874 | 703 | 595 |
| Comparative Example 4 | Comparative Steel 4 | 1146 | 855 | 40 | 834 | 689 | 576 |
| Comparative Example 5 | Comparative Steel 5 | 1174 | 846 | 35 | 822 | 706 | 599 |
| Comparative Example 6 | Comparative Steel 6 | 1155 | 906 | 25 | 854 | 722 | 571 |
| Comparative Example 7 | Comparative Steel 7 | 1150 | 874 | 20 | 894 | 735 | 588 |
| Comparative Example 8 | Comparative Steel 8 | 1167 | 841 | 40 | 871 | 711 | 593 |

TABLE 3

| Classification | Steel Grade | Base material yield strength (MPa) | Base material impact transition temperature (° C) | Heat input amount (kJ/cm) | Fusion Line (FL) to FL + 1 mm area EBSD measurement effective grain size (μm) | Fusion Line average CVN Energy @ −196° C. (J) | Fusion Line + 1 mm average CVN Energy @ −196° C. (J) |
|---|---|---|---|---|---|---|---|
| Inventive Example 1 | Inventive Steel 1 | 635 | −196 or lower | 19 | 38.6 | 132 | 144 |
| Inventive Example 2 | Inventive Steel 2 | 629 | −196 or lower | 25 | 42.1 | 142 | 152 |
| Inventive Example 3 | Inventive Steel 3 | 655 | −196 or lower | 38 | 37.4 | 101 | 132 |
| Inventive Example 4 | Inventive Steel 4 | 599 | −196 or lower | 9 | 39.5 | 82 | 109 |

TABLE 3-continued

| Classification | Steel Grade | Base material yield strength (MPa) | Base material impact transition temperature (° C) | Heat input amount (kJ/cm) | Fusion Line (FL) to FL + 1 mm area EBSD measurement effective grain size (μm) | Fusion Line average CVN Energy @ −196° C. (J) | Fusion Line + 1 mm average CVN Energy @ −196° C. (J) |
|---|---|---|---|---|---|---|---|
| Inventive Example 5 | Inventive Steel 5 | 643 | −196 or lower | 24 | 47.5 | 146 | 175 |
| Inventive Example 6 | Inventive Steel 6 | 621 | −196 or lower | 42 | 46.9 | 98 | 106 |
| Comparative Example 1 | Comparative Steel 1 | 721 | −172 | 39 | 31.7 | 59 | 89 |
| Comparative Example 2 | Comparative Steel 2 | 648 | −196 or lower | 27 | 75.6 | 68 | 93 |
| Comparative Example 3 | Comparative Steel 3 | 671 | −168 | 16 | 25.4 | 41 | 65 |
| Comparative Example 4 | Comparative Steel 4 | 741 | −162 | 10 | 42.2 | 39 | 66 |
| Comparative Example 5 | Comparative Steel 5 | 544 | −145 | 29 | 18.9 | 12 | 18 |
| Comparative Example 6 | Comparative Steel 6 | 719 | −162 | 35 | 38.9 | 23 | 35 |
| Comparative Example 7 | Comparative Steel 7 | 628 | −159 | 41 | 43.2 | 16 | 15 |
| Comparative Example 8 | Comparative Steel 8 | 746 | −164 | 41 | 37.6 | 36 | 64 |

As illustrated in Tables 1 to 3, Comparative Example 1 has a value higher than the upper limit of Ti suggested in the present disclosure, and accordingly, as the Ti/N ratio is higher than the range suggested in the present disclosure. Therefore, the coarse TiN phase was formed due to the addition of a large amount of Ti. As a large amount of TiC was formed during tempering, the base material had high strength. Thus, it can be seen that the impact transition temperature of the base material was −196° C. or higher, and the impact toughness measured in the area of the fusion line (FL) to FL+1 mm was 70J or lower at −196° C.

In the case of Comparative Example 2, a value lower than the lower limit of Ti suggested in the present disclosure is provided, and thus, a sufficient TiN phase was not formed in the weld heat-affected zone. As a result, it can be seen that, in the weld heat-affected zone, the effective grain size with a boundary angle of 15 degrees or more measured by the EBSD method in the area of fusion line (FL) to FL+1 mm is 50 micrometers or more, and the impact toughness measured in the area of fusion line (FL) to FL+1 mm was 70 J or less at −196° C.

In the case of Comparative Example 3, as the Ti/N ratio was lower than the range of Ti/N ratio suggested in the present disclosure, a sufficient fine TiN phase was formed in the weld heat-affected zone, and it can be seen that in the weld heat-affected zone, the effective grain size with a boundary angle of 15 degrees or more, measured by the EBSD method, in the area of fusion line (FL) to FL+1 mm, was 50 micrometers or less, but as the amount of free N that could not be precipitated as TiN was relatively high, the impact transition temperature of the base material was −196° C. or higher, and the impact toughness measured in the area of fusion line (FL) to FL+1 mm was 70 J or lower at −196° C.

In the case of Comparative Example 4, by having a value higher than the upper limit of C suggested in the present disclosure, a high strength value was obtained due to excessive hardenability, and thus, it can be seen that the impact transition temperature of the base material was −196° C. or higher, and the impact toughness measured in the area of the fusion line (FL) to FL+1 mm was 70 J or lower at −196° C.

In the case of Comparative Example 5, by having a value lower than the lower limit of Ni suggested in the present disclosure, the yield strength of the base material was 585 MPa or less due to insufficient hardenability, and it can be seen that the impact transition temperature of the base material was −196° C. or higher due to the decrease in toughness due to the addition of an insufficient amount of Ni, and the impact toughness measured in the area of fusion line (FL) to FL+1 mm was 70 J or lower at −196° C.

In the case of Comparative Example 6, by having a value higher than the upper limit of Mo and Cr suggested in the present disclosure, a high strength value is obtained due to excessive hardenability, and thus, it can be seen that the impact transition temperature of the base material was −196° C. or higher, and the impact toughness measured in the area of fusion line (FL) to FL+1 mm, which is a weld heat-affected zone, was 70 J or lower at −196° C.

In the case of Comparative Example 7, by having a value higher than the upper limit of Si and P, S suggested in the present disclosure, brittleness was caused by P and S segregation and an increase in the strength of the welding portion. Thus, it can be seen that the impact transition temperature of the base material was −196° C. or higher and the impact toughness measured in the area of fusion line (FL) to FL+1 mm, which is a weld heat-affected zone, was 70 J or lower at −196° C.

In the case of Comparative Example 8, by having a value higher than the upper limit of Mn suggested in the present disclosure, a high strength value is obtained due to excessive hardenability. Therefore, it can be seen that the impact transition temperature of the base material was −196° C. or higher, and the impact toughness measured in the area of fusion line (FL) to FL+1 mm, a weld heat-affected zone, was 70 J or lower at −196° C.

Meanwhile, in the case of Inventive Examples 1 to 6, which satisfies the component range suggested by the present disclosure and in which the Ti/N weight % ratio satisfies the range of 2.5 to 4; the yield strength of the base material was 585 MPa or more and the impact transition temperature was −196 or lower. In addition, it can be seen that by TiN precipitation, in a weld heat-affected zone of a welding portion welded with a heat input of 5 to 50 kJ/cm, an effective grain size having a boundary angle of 15 degrees or greater in an area of a fusion line (FL) to FL+1 mm, measured by an EBSD method, was 50 micrometers or less, and an impact toughness measured in the area of the fusion line (FL) to FL+1 mm was 70 J or higher at −196° C.

The invention claimed is:

1. A low-temperature steel material having excellent welding-portion toughness, consisting of:

in weight %, 0.02 to 0.06% of C, 6.0 to 7.5% of Ni, 0.4 to 1.0% of Mn, 0.02 to 0.15% of Si, 0.02 to 0.3% of Mo, 0.02 to 0.3% of Cr, 50 ppm or less of P, 10 ppm or less of S, 0.005 to 0.015% of Ti, 60 ppm or less of N, a Ti/N weight % ratio of 2.5 of 4, and a balance of iron (Fe) and other unavoidable impurities, wherein in a weld heat-affected zone of a welding portion welded with a heat input of 5 to 50 kJ/cm, an effective grain size having a boundary angle of 15 degrees or greater in an area of a fusion line (FL) to FL+1 mm, measured by Electron backscatter diffraction (EBSD), is 50 micrometers or less, and an impact toughness measured in the area of the fusion line (FL) to FL+1 mm is 70 J or higher at −196° C.

2. The low-temperature steel material having excellent welding-portion toughness of claim 1, wherein a yield strength of the low-temperature steel material is 585 MPa or higher.

3. The low-temperature steel material having excellent welding-portion toughness of claim 1, wherein an impact transition temperature of the low-temperature steel material is −196° C. or lower.

4. The low-temperature steel material having excellent welding-portion toughness of claim 1, wherein a thickness of the low-temperature steel material is 5 to 50 mm.

5. A method of manufacturing the low-temperature steel material having excellent welding-portion toughness according to claim 1, comprising:

a slab reheating operation of reheating a slab to a temperature of 1100 to 1200° C., the slab consisting of, in weight %, 0.02 to 0.06% of C, 6.0 to 7.5% of Ni, 0.4 to 1.0% of Mn, 0.02 to 0.15% of Si, 0.02 to 0.3% of Mo, 0.02 to 0.3% of Cr, 50 ppm or less of P, 10 ppm or less of S, 60 ppm or less of N, 0.005 to 0.015% of Ti, a Ti/N weight % ratio of 2.5 to 4, and a balance of iron (Fe) and other unavoidable impurities;

a hot rolling operation of obtaining a hot-rolled steel sheet by hot rolling the slab reheated in the slab reheating operation;

air-cooling the hot rolled steel sheet;

a single-phase region heat treatment quenching operation of reheating the air-cooled steel sheet to 800 to 950° C. and then performing quenching through water cooling;

after the single-phase region heat treatment quenching operation, a two-phase region heat treatment quenching operation of reheating the steel sheet to a two-phase region temperature of 680 to 750° C., and then, performing quenching through water cooling; and reheating the steel sheet to 570 to 620° C., followed by tempering, and then, performing air cooling, after the two-phase region heat treatment quenching operation.

6. The method of manufacturing a low-temperature steel material having excellent welding-portion toughness of claim 5, wherein a hot finish rolling temperature during the hot rolling is 700 to 1000° C.

7. The method of manufacturing a low-temperature steel material having excellent welding-portion toughness of claim 5, wherein the tempering is performed for 1.9t+40 to 80 minutes, where t is a thickness of a steel sheet (mm).

8. The method of manufacturing a low-temperature steel material having excellent welding-portion toughness of claim 5, wherein a thickness of the hot-rolled steel sheet is 5 to 50 mm.

9. The low-temperature steel material having excellent welding-portion toughness of claim 1, comprising 0.5 to 0.9% of Mn.

* * * * *